US005755128A

United States Patent [19]

Tippins et al.

[11] Patent Number: 5,755,128

[45] Date of Patent: May 26, 1998

[54] METHOD AND APPARATUS FOR ISOTHERMALLY ROLLING STRIP PRODUCT

[75] Inventors: George W. Tippins; John E. Thomas, both of Pittsburgh, Pa.

[73] Assignee: Tippins Incorporated, Pittsburgh, Pa.

[21] Appl. No.: 521,827

[22] Filed: Aug. 31, 1995

[51] Int. Cl.[6] ..... B21B 37/58

[52] U.S. Cl. ..... 72/10.4; 72/14.4; 72/12.2; 72/202; 72/229; 72/342.5; 72/365.2

[58] Field of Search ..... 72/8.5, 12.2, 11.3, 72/201, 202, 229, 365.2, 364, 342.5, 11.1, 12.1, 38, 209, 342.94, 220, 10.4, 10.6, 14.4

[56] References Cited

U.S. PATENT DOCUMENTS

| | | | |
|---|---|---|---|
| 3,606,778 | 9/1971 | Bomberger | 72/12.2 |
| 3,610,315 | 10/1971 | Juergens et al. | 164/76 |
| 4,407,486 | 10/1983 | Mills et al. | 266/87 |
| 4,430,876 | 2/1984 | Ginzburg | 72/234 |
| 4,433,566 | 2/1984 | Tippins et al. | 72/229 |
| 4,491,006 | 1/1985 | Ginzburg et al. | 72/202 |
| 4,503,697 | 3/1985 | Tippins et al. | 72/202 |
| 4,522,050 | 6/1985 | Thomas | 72/229 |
| 4,555,922 | 12/1985 | Ginzburg | 72/229 |
| 4,627,259 | 12/1986 | Andersson et al. | 72/202 |
| 4,700,557 | 10/1987 | De Mol et al. | 72/201 |
| 4,751,360 | 6/1988 | Ross | 219/10.61 R |
| 5,042,281 | 8/1991 | Metcalfe | 72/200 |
| 5,047,964 | 9/1991 | Lalli | 72/12.2 |
| 5,133,205 | 7/1992 | Rostik et al. | 72/200 |
| 5,195,344 | 3/1993 | Masuda et al. | 72/200 |
| 5,269,166 | 12/1993 | Thomas | 72/202 |
| 5,515,705 | 5/1996 | Weldon et al. | 72/19.1 |
| 5,540,074 | 7/1996 | Smith et al. | 72/229 |

FOREIGN PATENT DOCUMENTS

| | | | |
|---|---|---|---|
| 59-101212 | 6/1984 | Japan | 72/11.3 |
| 61-238411 | 10/1986 | Japan | 72/229 |
| 61-266117 | 11/1986 | Japan | 72/202 |
| 62-151209 | 7/1987 | Japan | 72/229 |
| 0342101 | 2/1991 | Japan | 72/38 |
| 0969346 | 11/1982 | U.S.S.R. | 72/229 |

*Primary Examiner*—Lowell A. Larson
*Assistant Examiner*—Ed Tolan
*Attorney, Agent, or Firm*—Webb Ziesenheim Bruening Logsdon Orkin & Hanson, P.C.

[57] ABSTRACT

The present invention provides a hot reversing rolling mill for isothermally reducing a metal strip product. The mill includes a hot reversing mill stand with a pair of coilers positioned on opposite sides of the mill stand. At least one heater is positioned between one of the coilers and the mill stand with at least one strip cooling unit positioned between one of the coilers and the mill stand. A sensor is provided for sensing a strip parameter indicative of strip temperature as well as a controller for controlling each of the heating and cooling units in response to the sensed parameter. The rolling mill of the present invention can be utilized for isothermally rolling multiple passes of a metal strip product on the hot reversing mill.

17 Claims, 4 Drawing Sheets

METHOD AND APPARATUS FOR ISOTHERMALLY ROLLING STRIP PRODUCT

BACKGROUND OF THE INVENTION

1. Field of the Invention

The present invention relates to a method and apparatus for isothermally rolling slab products to strip or plate products on a processing line which includes at least one hot reversing mill stand.

2. Prior Art

It has been recognized for many years that strip shape is dependent on many factors, including the temperature at which hot rolling takes place. This dependence on temperature relates not only on the minimum temperatures needed for hot rolling to achieve the desired metallurgical properties, but also on any head to tail temperature differential which occurs and which then may change rolling conditions and result in shape problems. These temperature differentials are inherent in the rolling of the strip via a hot reversing mill because of the temperature decay which takes place over time and the difference in exposure time to ambient conditions at various positions along the product being rolled. Not only is there a temperature drop at the respective ends of the coil, but the extreme head and tail positions of the product realize greater heat decay because the lack of a heat reservoir ahead and to the rear of the head and tail positions, respectively. In addition, there tends to be a temperature buildup in the middle portion of the strip due to frictional forces. All of these conditions will vary with the width of the strip.

In addition to strip shape, thickness tolerances must be maintained through such techniques as roll bending and automatic gauge control. These techniques may change rolling conditions and, thus, actually exacerbate the problem of temperature differentials.

A number of rolling methods and apparatus have been tried and are employed to correct these shape problems. Many such efforts are directed to correcting the shape should it be less than desired. Other solutions address the cause of the problem and attempt to reduce the head to tail temperature differential in the first place. These include tapered slabs, tapered rolling, coil boxes upstream of the rolling mill and zoom rolling wherein the speed of rolling is accelerated to create frictional heat energy to increase the temperature of the tail of the workpiece.

Applicants and their assignee, Tippins Incorporated, have utilized various types of hot reversing mills and coiler furnaces to minimize head to tail temperature differentials and resultant shape problems. Typical of such efforts are U.S. Pat. Nos. 4,555,922; 4,522,050; 4,503,697; 4,491,006; 4,433,566; and 4,430,876.

Although many of the above techniques have had varying degrees of success, there remains a need for a method and apparatus which go to the root cause of the problem, namely, the change in temperature which takes in a slab product being rolled to strip thickness, albeit on existing continuous, semicontinuous and the existing various mini-mill arrangements which include different forms of hot reversing mills.

An object of this invention is to achieve isothermal rolling temperatures throughout any given pass through a mill stand. By isothermal rolling temperature, it is meant as reasonably constant as possible so as to have a negligible effect on resultant shape.

It is also an object of this invention to achieve these isothermal rolling temperatures by heating or cooling the strip being rolled in advance of the roll bite.

It is also an object of this invention to monitor temperature or temperature-dependent functions such as roll force so as to provide control loops for achieving the isothermal rolling temperatures.

SUMMARY OF THE INVENTION

The objects of the present invention are achieved by providing a hot reversing rolling mill which isothermally reduces a metal strip product. The mill includes at least one hot reversing mill stand with a pair of coilers positioned on opposite sides of the mill stand. The coilers may be in the form of coiler furnaces for reheating of a coiled strip between passes on the hot reversing mill stand. At least one strip heater is positioned between one of the coilers and the mill stand and at least one strip cooling unit, such as a laminar flow cooling spray, is positioned between one of the coilers and the mill stand. A device for sensing a strip parameter, which is indicative of strip temperatures, is provided together with a device for controlling the heater and cooling units in response to the sensed parameter of the workpiece. Isothermal rolling conditions are met by either heating or cooling portions of the strip based upon the sensed strip temperature.

The sensing device may include a load sensor sensing a mill load on the mill stand. Each strip heater may be positioned below the pass line of the hot rolling mill with each cooling unit comprising a cooling spray positioned above the pass line. The strip heaters may take the form of a plurality of quick-acting edge heating units positioned side-by-side across the width of the strip. An induction heating unit may also be used.

The hot rolling mill of the present invention may provide a second reversing mill stand positioned between the coilers with a strip heater and cooling unit positioned between the mill stands.

The above-described apparatus provides a method of isothermally rolling, in multiple passes, a metal strip product on a hot rolling mill according to the present invention. The method according to the present invention includes the steps of passing a product at a specific hot rolling temperature through a rolling mill, sensing one of a temperature condition or a temperature-dependent condition at spaced positions on the product being rolled and the step of heating or cooling portions of the product in response to the predetermined differentials between the sensed conditions to achieve the isothermal rolling conditions at the hot rolling temperature. The method according to the present invention is repeated for multiple passes through at least one hot reversing mill.

The present invention provides a feedback control system for isothermally rolling the strip product, thereby providing a self-learning or adaptive process which can be continually adjusted to maintain the product at an appropriate isothermal rolling condition.

These and other advantages of the present invention will become apparent in the description of the preferred embodiments taken together with the attached figures.

DESCRIPTION OF THE PREFERRED EMBODIMENTS

Figure 1:
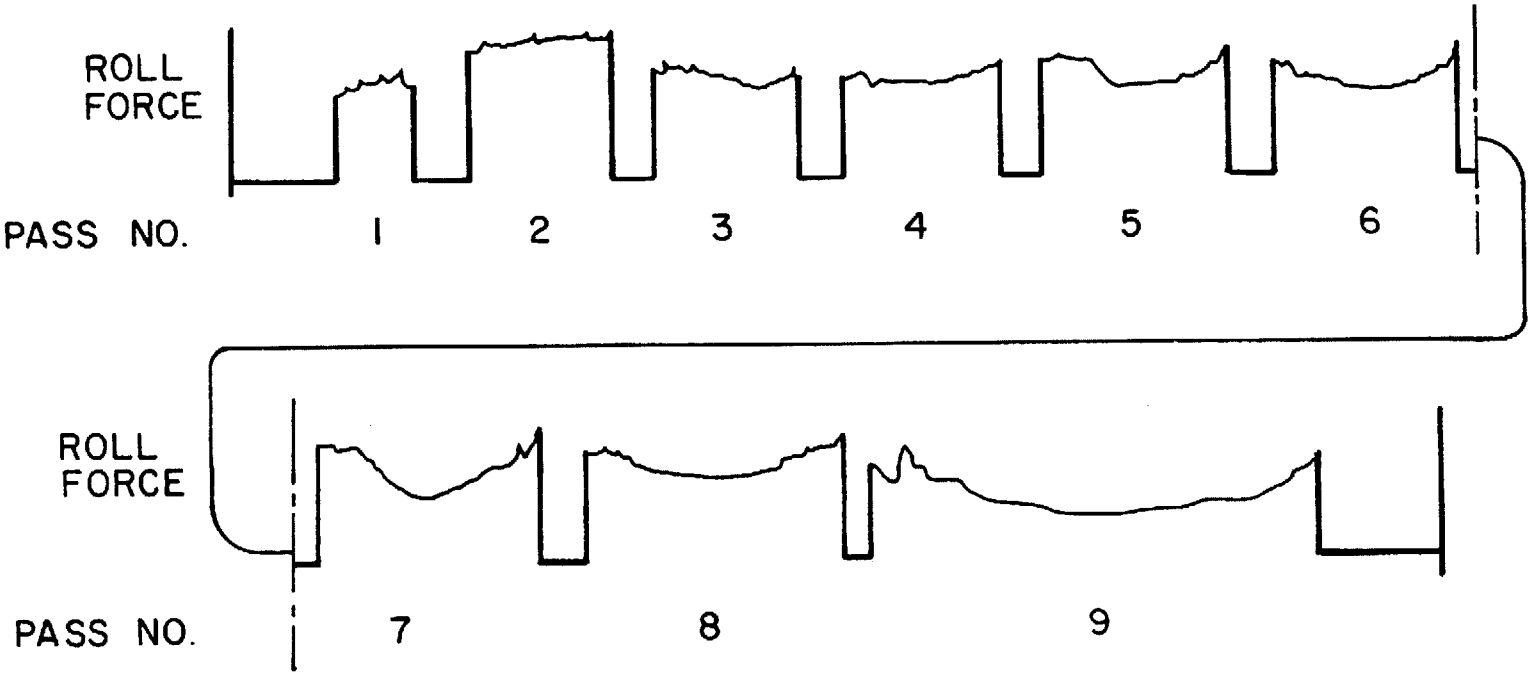
FIG. 1 illustrates a chart of separating forces during conventional rolling through a single stand hot reversing mill.
Figure 2:
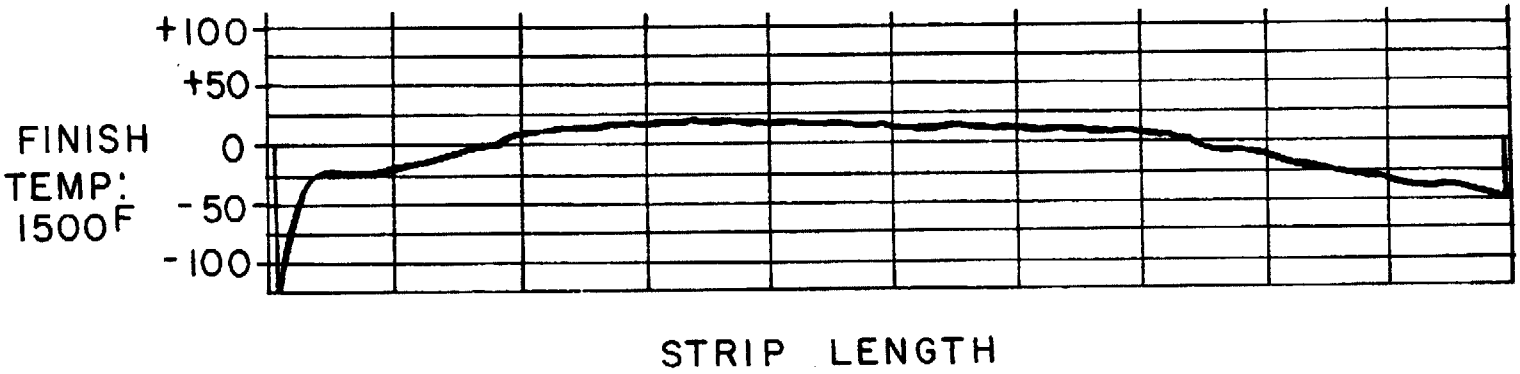
FIG. 2 is a temperature profile of the workpiece during the last pass illustrated in FIG. 1.

Rolling with automatic gauge control of the front and tail ends of a workpiece can produce a sheet product with an extremely small variation in strip thicknesses; however, the rolling function does induce internal stresses into the front and tail portions of the strip. These stresses are not apparent during the hot rolling process. However, after the workpiece cools and it is cut into pieces for fabrication, it is likely that the sheet will deform as the internal stresses are released which, of course, makes the ends of the workpiece unfit for use. FIG. 1 is a representation of an actual recording of the separating forces required for each of nine passes through a single stand hot reversing mill according to the conventional rolling procedures. The magnitude of the separating force over any pass is directly related to the resistance of deformation of the material being worked. The resistance of deformation, in turn, is inversely related to the temperature of the workpiece. FIG. 2 illustrates the temperature profile of the strip during the last pass, pass nine, illustrated in FIG. 1. FIGS. 1 and 2 clearly demonstrate the inverse relationship between the separating force and the temperature of the workpiece. Consequently, a measurement of the separating force will provide a substantially accurate measurement of the temperature of the workpiece.

Due to the nature of hot reversing mills of the prior art, the front and back ends of the workpiece are inherently colder than the center portion. This characteristic is best illustrated in FIG. 2 where the temperature of the ends of the workpiece is shown substantially lower than that of the center. Although not specifically illustrated, a chart of the temperature for each of the previous eight passes would show similar decays in the temperature of the head and tail ends of the strip to a somewhat lesser degree. Referring to FIG. 1 illustrating the separating forces which are inversely proportional to the temperature of the strip, it can be seen that as early as pass three the ends of the strip are exhibiting a loss of rolling temperature (i.e., an increase in the separating force measured). As demonstrated in subsequent passes, this characteristic is increased with each subsequent pass. Furthermore, an attempt to add heat to the strip prior to the last pass of the strip does not cure the problem since the strip has already been deformed and worked and certain stresses may have been added and not dissipated in each of the previous passes.

As described herein, the present invention will monitor the rolling forces and, consequently, temperature and take corrective action to automatically add heat energy to the ends of the workpiece and/or cool the center of the strip, as required, for each pass. With this method, the mill will roll the workpiece in an isothermal condition throughout its length. The rolling of the workpiece under isothermal conditions helps increase the metallurgical properties of the resulting product, and decrease the end spread and non-uniform gauge presented and most importantly prevents the growth of internal stresses in the workpiece.

Both the head to tail strip temperature differential and the absolute rolling temperature must be controlled for optimum strip properties. Monitoring and responding to early drifts in strip temperature make it possible to correct both the absolute rolling temperature and any head to tail differential in the workpiece on a per pass basis. As discussed above, the strip temperature can be simulated as an inverse function of a mill load and this result utilized for automatic control.

Figure 3:
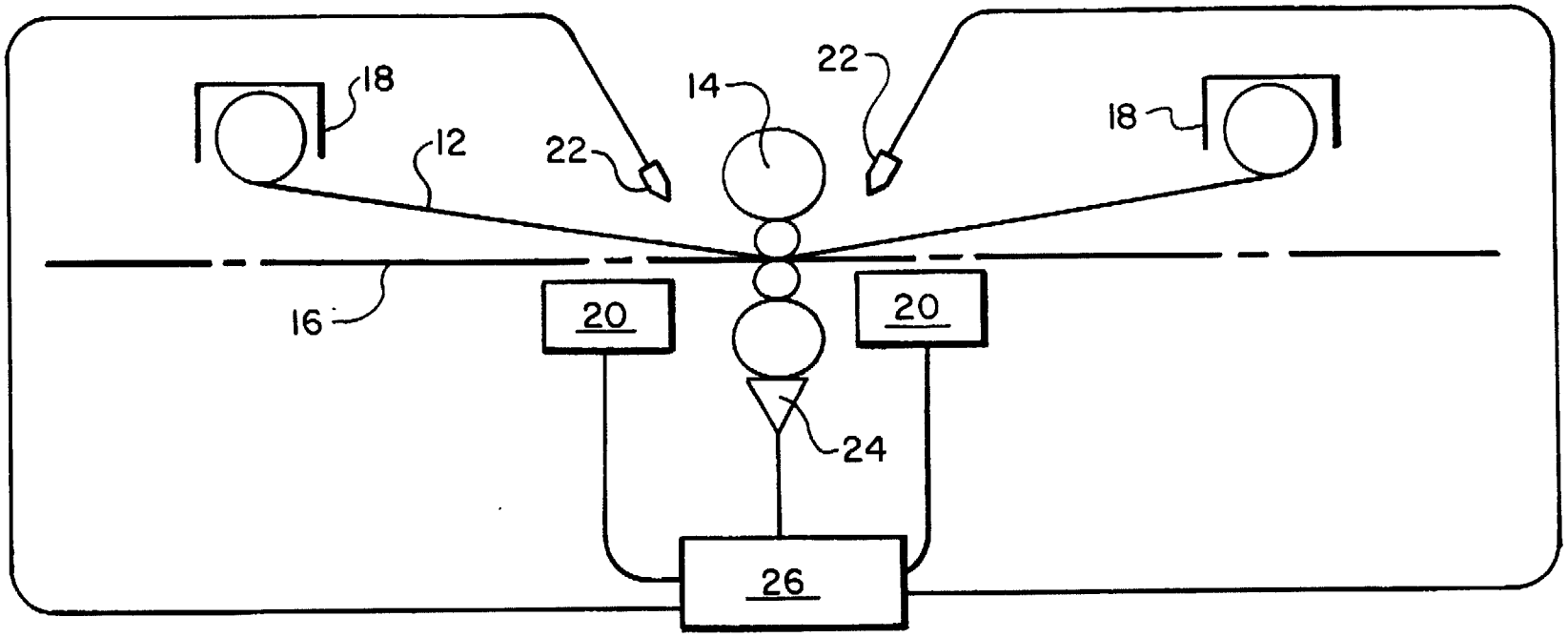
FIG. 3 schematically illustrates a reversing rolling mill according to the present invention.

FIG. 3 illustrates a hot rolling mill 10 for isothermally reducing a metal strip product 12 according to the present invention. The mill 10 includes a four-high reversing hot mill stand 14 positioned on the pass line 16 for the strip product 12. A pair of coiler furnaces 18 is positioned on opposite sides of the mill stand 14.

A strip heating unit 20 is positioned between each coiler furnace 18 and the mill stand 14. Each heating unit 20 may be formed of a plurality of fast-acting edge heating burners positioned in a side-by-side relationship across the width of the strip product 12. Alternatively, an induction heating unit can be utilized on the strip. Regardless of the specific type of heating unit 20 utilized, the requirements are that the heating unit 20 be operable to quickly add a significant amount of heat energy to the strip product 12. Power may be switched from one heating unit 20 to the opposite heating unit 20 when no load is in the mill stand 14, thereby rendering operable only the heating unit 20 on the entry side of the mill stand 14 throughout the rolling process.

A laminar cooling spray 22 is additionally positioned between each coiler furnace 18 and the mill stand 14. The cooling spray 22 should preferably be actuated by a quick-acting valve. The cooling spray 22 may be water or other conventional cooling fluid for use in cooling metal strip products.

A force sensor 24 is attached to the rolling mill stand 14 for sensing the load or separating force thereon. The force sensor 24 is coupled to a controller 26 which controls the operation of each heating unit 20 and cooling spray 22. The sensor 24 can measure a variety of parameters indicative of a load such as temperature or horsepower.

In operation, the force sensor 24 determines the separating force on the strip product 12 during the pass. This sensed strip parameter is indicative of the temperature of the strip product 12 as described above. Additionally, the difference between the sensed parameter and a predetermined value is determined by controller 26 with the results used to control the heating units 20 and cooling sprays 22 when the difference is greater than a set amount. The cooling spray 22 or heating unit 20 is activated by the controller 26, as appropriate, to modify the temperature condition of a portion of the strip product 12.

The system according to the present invention thereby provides a feedback control loop which allows the process to be a self-learning adaptive process as the strip product 12 is rolled. By rolling according to the present method, the wide variations in separating force and, consequently, temperature illustrated in the later passes of FIG. 1 can be eliminated or reduced. This isothermal rolling process can improve the metallurgical properties, the gauge, product yield and other associated properties of the final product.

Figure 4:
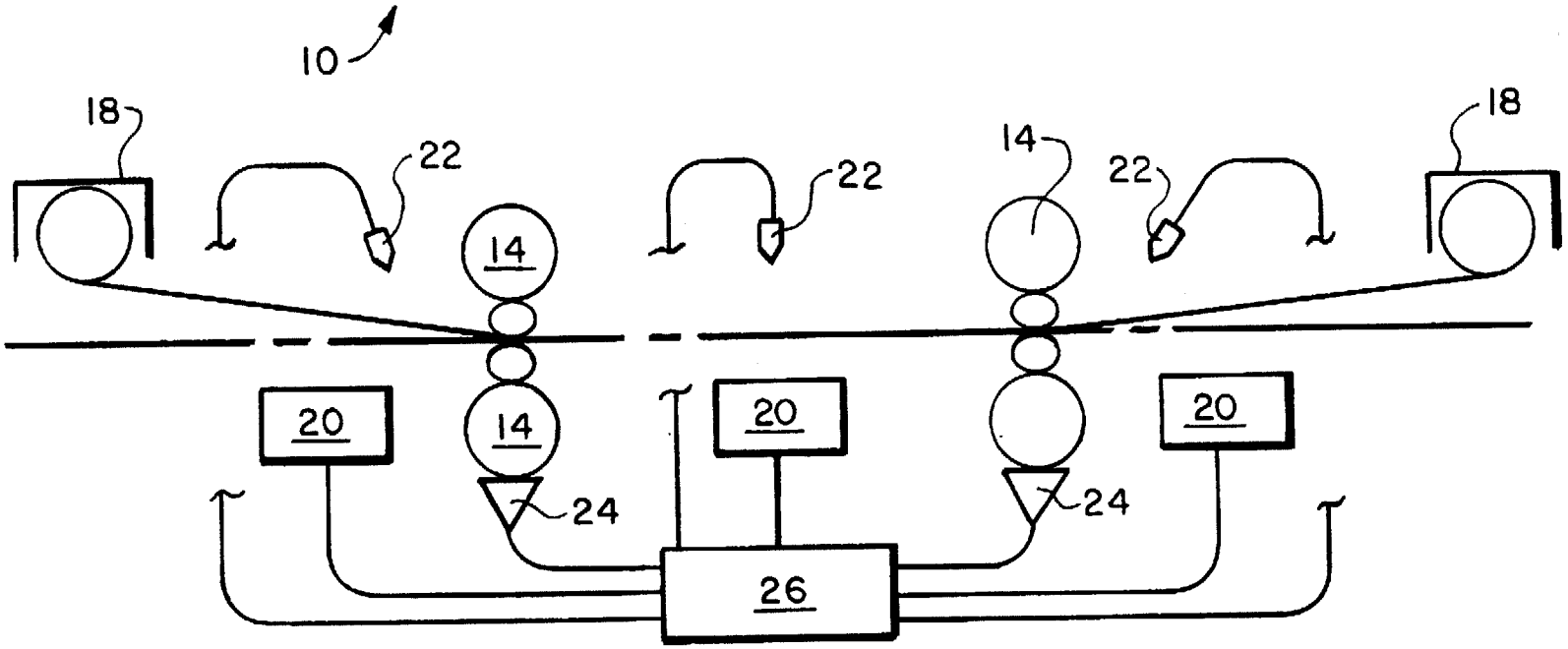
FIG. 4 schematically illustrates a hot reversing mill according to a second embodiment of the present invention.

FIG. 4 illustrates a second embodiment according to the present invention. Mill 30 is substantially the same as mill 10 disclosed in FIG. 1. Mill 30 includes mill stand 14, coiler furnaces 18, heating unit 20, cooling spray 22, force sensor 24 and controller 26 operating substantially as described above in connection with mill 10. However, mill 30 provides a second mill stand 14 operating in tandem with the first mill stand 14 and additionally provides a heating unit 20 and cooling spray 22 positioned between the first and second mill stands 14. A second force sensor 24 is provided on the second mill stand 14 to determine the load force therefrom.

In the twin mill stand embodiment illustrated in FIG. 4, it is not essential to include the additional heating unit 20 between the rolling mill stands 14. The present invention can be utilized with heating units 20 and cooling sprays 22 positioned on either side of the pair of mill stands 14 allowing the heating or cooling to be effective before entering the tandem mill stands 14. The provision of the additional heating unit positioned between the mill stands 14 merely provides additional control over the process.

The heating units 20 are preferably positioned below the pass line 16 since these heating units can generally be more easily accommodated in this position. Specifically, in a position below the pass line, the heating units 20 can be easily positioned between rolls of the roller table. The cooling sprays 22 are preferably positioned above the pass line 16 to allow for gravity assistance of the cooling sprays.

It should be apparent to those of ordinary skill in the art that various modifications may be made to the present invention without departing from the spirit and scope thereof. Consequently, the scope of the present invention is intended to be defined by the attached claims.

What is claimed is:

1. A hot rolling mill for isothermally reducing a metal strip product, said mill comprising:

a hot reversing mill stand;

a pair of coilers positioned on opposite sides of said stand;

at least one strip heater positioned between one of said coilers and said mill stand;

at least one strip cooling unit positioned between one of said coilers and said mill stand;

a means for sensing a strip parameter indicative of strip temperature wherein said sensing means comprises a load sensor sensing a mill load on said mill stand; and a means for controlling each said heater and said cooling unit in response to said sensed mill load.

2. The mill of claim 1 wherein each said cooling unit comprises a cooling spray positioned only above a pass line.

3. The mill of claim 2 wherein each said strip heater is positioned only below said pass line.

4. The mill of claim 1 wherein each said coiler is part of a coiler furnace unit.

5. The mill of claim 1 further including a second reversing mill stand positioned between said coilers.

6. The mill of claim 5 wherein said sensing means comprises a load sensor sensing a mill load on both said mill stands.

7. A method of isothermally rolling in multiple passes a metal strip product on a hot rolling mill comprising:

a) passing a product at a hot rolling temperature through a rolling mill;

b) sensing a temperature-dependent condition at spaced positions on the product being rolled, wherein said sensing includes monitoring mill loads at the rolling mill and using said monitored mill loads as a temperature dependent condition; and c) one of heating and cooling portions of said product in response to predetermined differentials between the sensed conditions to achieve isothermal rolling conditions at the hot rolling temperature.

8. The method of claim 7 including introducing a coolant to portions of said product to achieve said isothermal rolling conditions.

9. The method of claim 7 wherein said sensing includes monitoring mill loads at a pair of hot reversing mill stands of the rolling mill and using said monitored mill loads as the temperature-dependent condition.

10. The method of claim 7 including passing said product back and forth through at least one hot reversing mill for multiple passes.

11. The method of claim 10 including coiling said product on coilers positioned on opposite sides of said at least one hot reversing mill when said product is reduced in thickness to a coilable thickness wherein each of said coiler is part of a coiler furnace unit.

12. The method of claim 11 wherein said heating occurs at a location between at least one of said coilers and said hot reversing mill.

13. The method of claim 12 wherein said heating equipment is only below said pass line.

14. In an isothermal hot rolling process carried out on a hot reversing rolling mill including at least one hot reversing stand having coiler units on opposite sides thereof, whereby product is converted to strip by passing said product back and forth through said reversing stand in successive passes to reduce the thickness and coiling said product when it reaches a coilable thickness, the improvement comprising the steps of:

providing a strip heater between at least one of said coiler units and said hot reversing stand;

sensing mill loads on the hot reversing stand;

comparing said sensed loads to predetermined load differentials which are a function of rolling temperature; and heating portions of said product with said strip heater in response to a predetermined condition of said comparison to maintain constant hot rolling temperatures throughout said product being rolled.

15. In a processing line including a hot reversing rolling mill for converting slab product to strip and a pair of coiler furnaces on opposite sides of said hot reversing mill, the improvement comprising a sensing unit for monitoring a rolling condition which is a function of temperature, a control unit for comparing said monitored conditions to a standard and heating means and cooling means located along the processing line proximate the rolling mill and responsive to said control unit wherein rolling temperatures are maintained constant throughout any given pass through the rolling mill.

16. The processing line of claim 15 wherein said rolling mill includes at least two hot reversing stands having said coilers on opposite sides thereof and a heating unit positioned between at least one of said coilers and said hot reversing mill.

17. The processing line of claim 15 wherein said heating unit is positioned only below a pass line of said mill processing line.

* * * * *